US009091096B2

(12) United States Patent
Cochrane

(10) Patent No.: US 9,091,096 B2
(45) Date of Patent: Jul. 28, 2015

(54) SECURITY FENCE

(75) Inventor: Ian Dundonald Cochrane, Iklin (MT)

(73) Assignee: Shield Projects Limited, Iklin (MT)

( * ) Notice: Subject to any disclaimer, the term of this patent is extended or adjusted under 35 U.S.C. 154(b) by 280 days.

(21) Appl. No.: 13/558,706

(22) Filed: Jul. 26, 2012

(65) Prior Publication Data

US 2013/0048934 A1 Feb. 28, 2013

(30) Foreign Application Priority Data

Jul. 26, 2011 (NE) ..... NG/P/2011/456

(51) Int. Cl.
*E04H 17/16* (2006.01)
*E04H 17/00* (2006.01)

(52) U.S. Cl.
CPC ..... *E04H 17/003* (2013.01); *E04H 17/161* (2013.01)

(58) Field of Classification Search
CPC ..... E04H 17/06; E04H 17/161
USPC ..... 256/24, 32, 33, 45, 47
See application file for complete search history.

(56) References Cited

U.S. PATENT DOCUMENTS

| | | | | |
|---|---|---|---|---|
| 4,003,178 | A * | 1/1977 | Douthwaite | 52/664 |
| 5,746,040 | A * | 5/1998 | Young et al. | 52/775 |
| 6,581,914 | B2 * | 6/2003 | Saura Sotillos et al. | 256/48 |
| 2006/0175590 | A1 * | 8/2006 | Fumagalli | 256/25 |
| 2007/0272908 | A1 * | 11/2007 | Sotillos | 256/35 |

FOREIGN PATENT DOCUMENTS

| | | | | |
|---|---|---|---|---|
| AU | 2008202993 | | 1/2010 | |
| CA | 2200891 | | 9/1998 | |
| EP | 1 098 051 | * | 5/2001 | E04H 17/20 |
| EP | 2065542 | | 6/2009 | |
| EP | 2243903 | | 10/2010 | |
| NL | 1027161 | | 4/2006 | |
| WO | WO 2010/121789 | * | 10/2010 | E04H 17/16 |

OTHER PUBLICATIONS

GB12130068 Search Report from the Intellectual Property Office of the United Kingdom, Nov. 7, 2012 (2 pages).

* cited by examiner

*Primary Examiner* — Michael P Ferguson
(74) *Attorney, Agent, or Firm* — Michael Best Friedrich LLP

(57) ABSTRACT

A fence panel which is made from mesh material and which includes at least one rigidifying channel which, in a region adjacent a respective end of the channel is of decreasing depth.

10 Claims, 12 Drawing Sheets

SECURITY FENCE

CROSS-REFERENCE TO RELATED APPLICATIONS

This patent application claims foreign priority to Nigerian Patent Application No. NG/P/2011/456, filed Jul. 26, 2011, the disclosure of which is incorporated by reference herein in its entirety. Priority to this application is hereby claimed.

BACKGROUND OF THE INVENTION

This invention relates to a fence which is suited for security applications.

The use of mesh material in a fencing application has become entrenched. An advantage of this material is that it is difficult to penetrate or climb but it still offers see-through visibility. Moreover, the mesh material is not unduly obtrusive and in general terms it is aesthetically satisfying.

The mesh material is normally formed into panels and each panel is positioned between, and secured to, a respective adjacent pair of posts. The fixing of the panels to the posts can be problematic for an attractive finish is required. Another aspect is that the distance between adjacent posts can be substantial and flexure in each panel can occur quite easily. Some form of stiffening of the panel is normally required. This can be done, for example, by making the panel with at least one transverse channel e.g. of V-shape.

FIG. 1 illustrates a prior art situation. Part of a mesh panel 10 is formed with a transversely extending stiffening formation 12 which, in cross-section, has a V-shape. The panel has a vertical flange 14 which abuts and which is secured to a post 16. A similar construction is adopted at an opposing end of the panel. At a junction 18 of the formation 12 and the post, a recess 20 is formed. This recess is fairly deep and can form a foothold for an intruder to climb over the fence. Another possible drawback is that a lever, inserted between the panel and the post, can be used to prise the panel free.

SUMMARY OF THE INVENTION

An object of the invention is to address the aforementioned problems.

The invention provides a fence panel which is made from mesh material and which includes at least one rigidifying channel which, in a region adjacent a respective end of the channel is of decreasing depth.

In cross-section the channel may be U-shaped, V-shaped or generally concave. The rigidifying channel may be formed by deforming the mesh in a suitable metal working process e.g. by means of a press. The nature of the process is such, though, that the channel, over its full length, does not have a constant cross-section. In a central part the channel is relatively deep. At opposed ends the depth decreases, preferably to zero. Thus, when the panel is fixed to a post, a foothold of the kind shown in FIG. 1 cannot be formed.

The capability of a press to deform the panel in the manner described is dependent, at least, on the type of metal used in the mesh. If the mesh material is not amenable to substantial distortion, by means of a press, to form the regions of decreasing depth, then an alternative technique can be used to obtain a similar type of construction. Vertically extending wires at opposed vertical edges of a panel are severed at selected locations before the rigidifying channel is formed. Ends of wires at opposed ends of the channel, also referred to as flying ends, are bent so that they are moved away from the deep channel shape and are gradually brought to a plane in which most of the panel is positioned. Thus the depth of the channel at each of its opposing ends is gradually reduced to zero by bending the flying ends appropriately. Portions of the vertical wires which were severed are removed as required and, if desired, ends of the severed vertical wires can be trimmed so that the ends can be butt-welded together. Alternatively the flying ends are braced by means of a suitable retention device which reinforces the end of the channel.

In a different form of the invention the depth of each region at the end of a channel is effectively reduced or decreased by means of a security device which includes a body with an obstructing section which projects at least partly into the channel.

The body may be formed with a plurality of slots to enable the appearance of the obstructing section, at least, to blend with the appearance of the mesh panel.

The body may include an anchor section which, in use, abuts a vertical edge portion of the mesh panel or which is adapted to be fixed to a post to which the panel is secured. The obstructing section may project from the anchoring section.

The body may include a plurality of spaced-apart formations which are positioned so that they are locatable in respective apertures in the mesh material.

The security device may be secured directly to the panel e.g. by means of welding or it may be attached to a post using any appropriate technique e.g. by means of a fastener or welding.

In a different form of the invention the security device is made from a moulded or cast plastics or other material and includes a plurality of formations into which ends of respective rods in the mesh panel are insertable.

BRIEF DESCRIPTION OF THE DRAWINGS

The invention is further described by way of examples with reference to the accompanying drawings in which.

DETAILED DESCRIPTION

Figure 2:
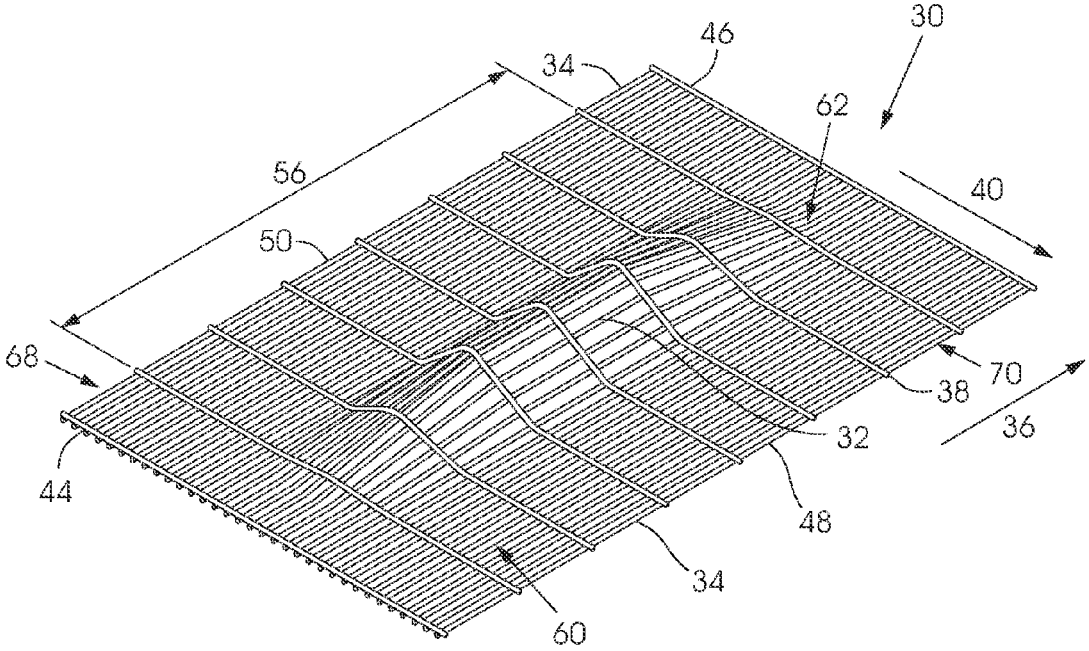
FIG. 2 is a perspective view of part of a fence panel according to one form of the invention.

FIG. 2 of the accompanying drawings is a perspective view of a portion of a sheet 30 of mesh material which includes a rigidifying channel 32.

The mesh material has a high density configuration and includes a plurality of steel rods 34 which are spaced apart and parallel to one another and which extend in a first direction 36, and a plurality of spaced apart and parallel steel rods 38 which extend in a second direction 40 which is at a right angle to the direction 36.

The rods 34 are relatively close to each other while the rods 38 are relatively far apart. This type of configuration is well suited to security applications for the mesh is difficult to penetrate with a bolt cutter and it is difficult for an intruder to scale or climb the mesh. On the other hand the panel does not unduly impede visibility and a fence erected using this type of mesh sheet is normally aesthetically acceptable.

The sheet 30 is rectangular or square in outline and includes a first edge 44, a second, opposing edge 46, a third edge 48 which is at a right angle to the edge 44 and a fourth, opposing edge 50.

Only a portion of the fence panel is illustrated. The panel may in fact have significant dimensions longitudinally and transversely.

The rigidifying channel 32 is formed in the mesh material by passing the mesh sheet through a suitable press. The relevant rods which are exposed to the press are bent and take on the shapes shown in the drawings. The rigidifying channel, over a substantial portion of its length 56, has a uniform cross-section. The channel has a first end 60 and a second opposing end 62. The channel has a depth, taken from a plane in which the remainder of the mesh material lies, which is at a maximum over a greater central portion of the length of the channel and which decreases, effectively to zero, at the first and second ends 60 and 62.

The mesh material, over a region 68 between the first edge 44 and the end 60, is planar and is not meaningfully deformed. Similarly, at the opposing end 62 of the formation the mesh material over a region 70 between the second edge 46 and the end 62, is planar and is not meaningfully deformed. This feature substantially facilitates the fixing of the panel to fence posts.

Figure 1:
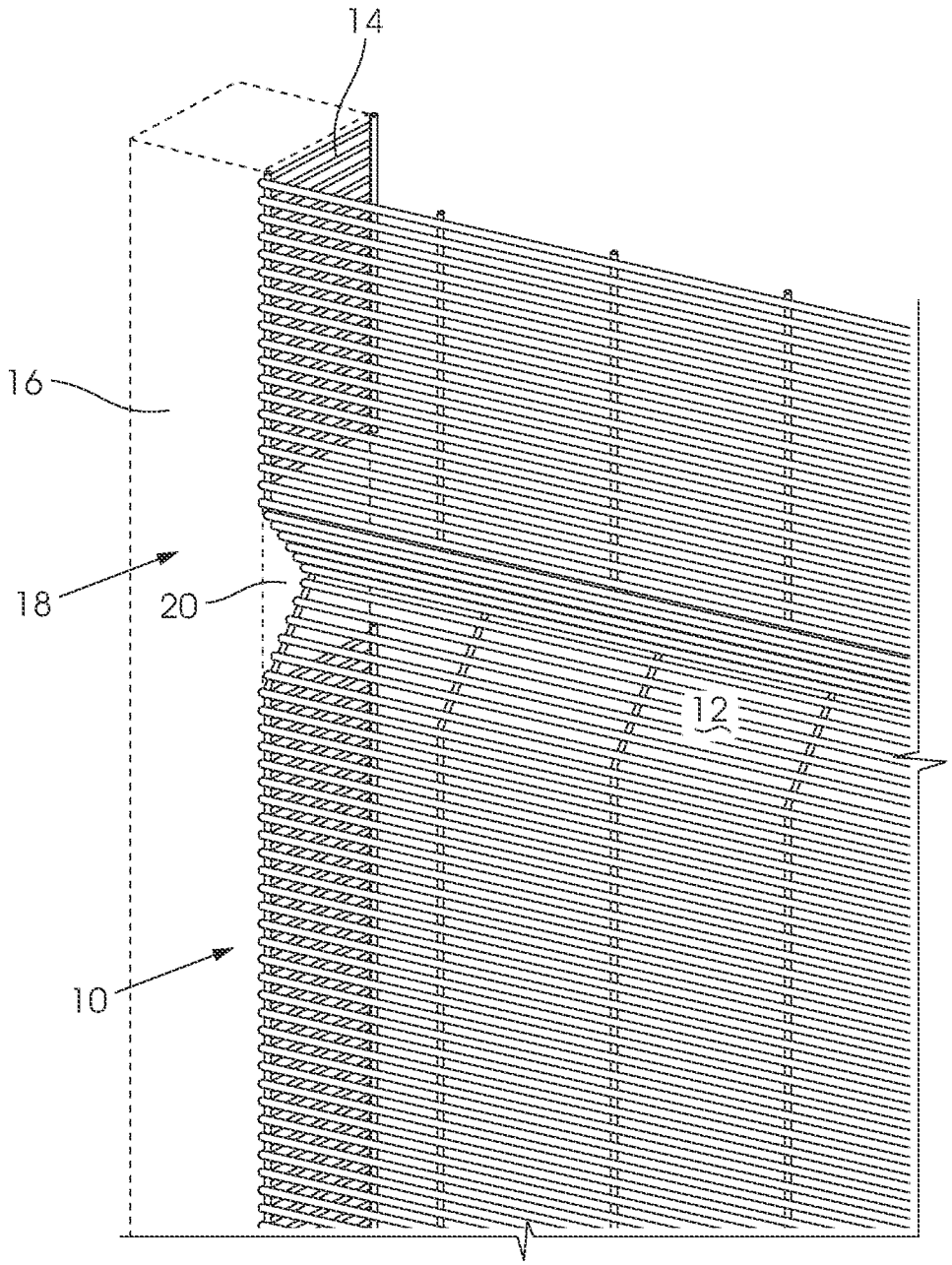
FIGURE 1 PRIOR ART
FIG. 1 illustrates a problem in a prior art situation which the current invention attempts to address.
Figure 3:
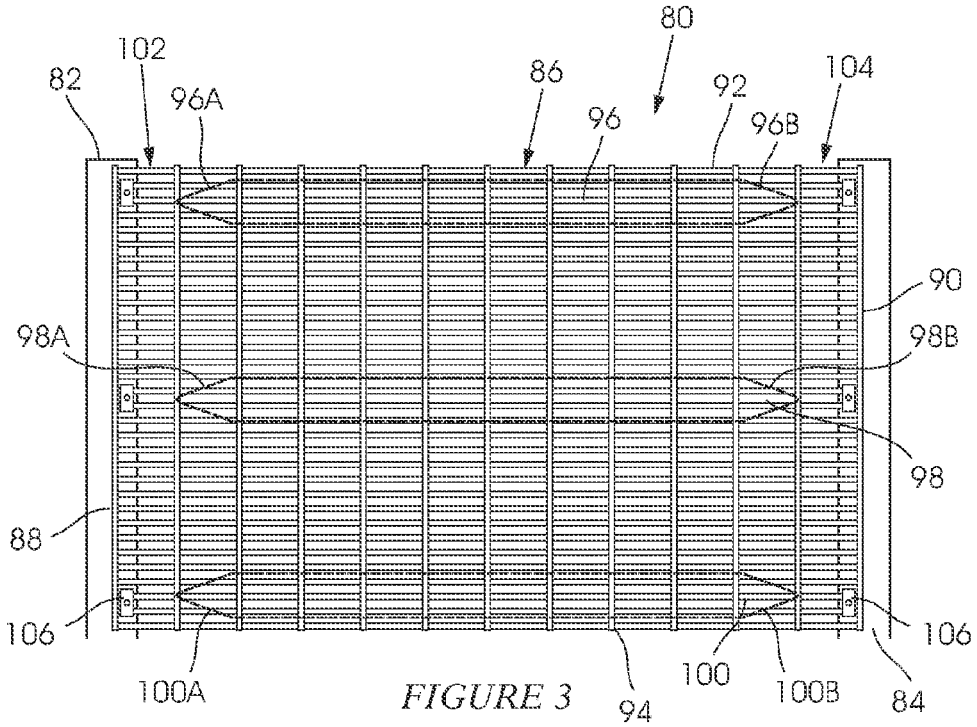
FIG. 3 is a side view of another panel according to the invention.

FIG. 3 is a view in elevation of a portion of a fence 80 which includes spaced apart, adjacent, first and second fence posts 82 and 84 and a mesh fencing panel 86 made in accordance with the principles which have been described. The mesh panel 86 has a first, vertical edge 88, a second, opposing edge 90, and third and fourth opposed, horizontal edges 92 and 94. Three spaced apart rigidifying channels 96, 98 and 100 respectively are formed in the mesh at chosen locations. The channels extend horizontally, substantially parallel to the edges 92 and 94. The channels have opposed ends 96A and 96B, 98A and 98B, and 100A and 100B, respectively which are spaced from the posts. Thus a portion 102 of the mesh sheet which is at the first edge 88, and a portion 104 of the mesh sheet which is at the second edge 90, are not deformed. These portions can lie flat against corresponding surfaces of the posts 82 and 84. Alternatively these portions could each be bent through 90° thereby to form respective flanges which are each at a right angle to the general plane occupied by the remainder of the mesh panel. The flanges can then be fixed to sides of the posts 82 and 84. This is similar to the construction shown in FIG. 1. Suitable fasteners 106, of any appropriate kind, are used to fix the panel to the posts.

As the ends of each channel are displaced from the respective adjacent posts, the channels and the posts do not act together to provide footholds which facilitate climbing of the panel.

Figure 4:
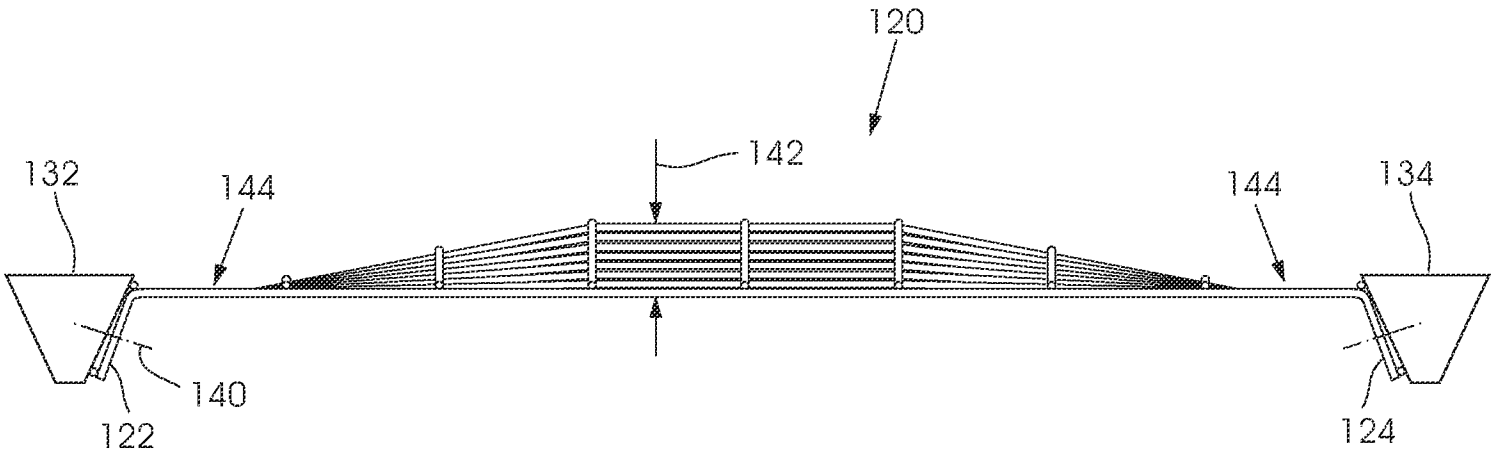
FIG. 4 is a view in plan of a fence panel attached to two adjacent fence posts.

In the examples shown in FIGS. 2 and 3 material of each mesh panel, adjacent vertical edges of the panel, is coplanar with the remainder of the panel. In a different arrangement shown in FIG. 4 a fence panel 120 is bent along its vertical edges to form flanges 122 and 124 which are angled to the plane occupied by the remainder of the panel. The angled flanges can be positioned in close abutment with corresponding sides of fence posts 132 and 134. Each post, in cross-section, has a trapezoidal or other shape which is complementary to the angle of the flange. Suitable fasteners 140, which are notionally shown, are used to secure the flanges and hence the panel to the posts. The channel has a maximum depth 142, which is reduced to zero over regions 144 at opposed ends.

In another form of the invention, before each rigidifying channel is formed, selected vertical rods are severed at locations which would be adjacent respective ends of the channel. The channel is then formed by using a bending brake. The rods which were previously severed are then bent and, optionally, are welded to one another, as appropriate, to ensure that a mesh configuration results, adjacent each respective end of the channel, which is coplanar with the remainder of the mesh panel so that a region is formed, at each channel end, over which the channel depth decreases to zero. The panel then has a general appearance similar to what is shown in FIG. 2 and, when the panel is attached to posts, the ends of the channel do not provide footholds.

Figure 5:
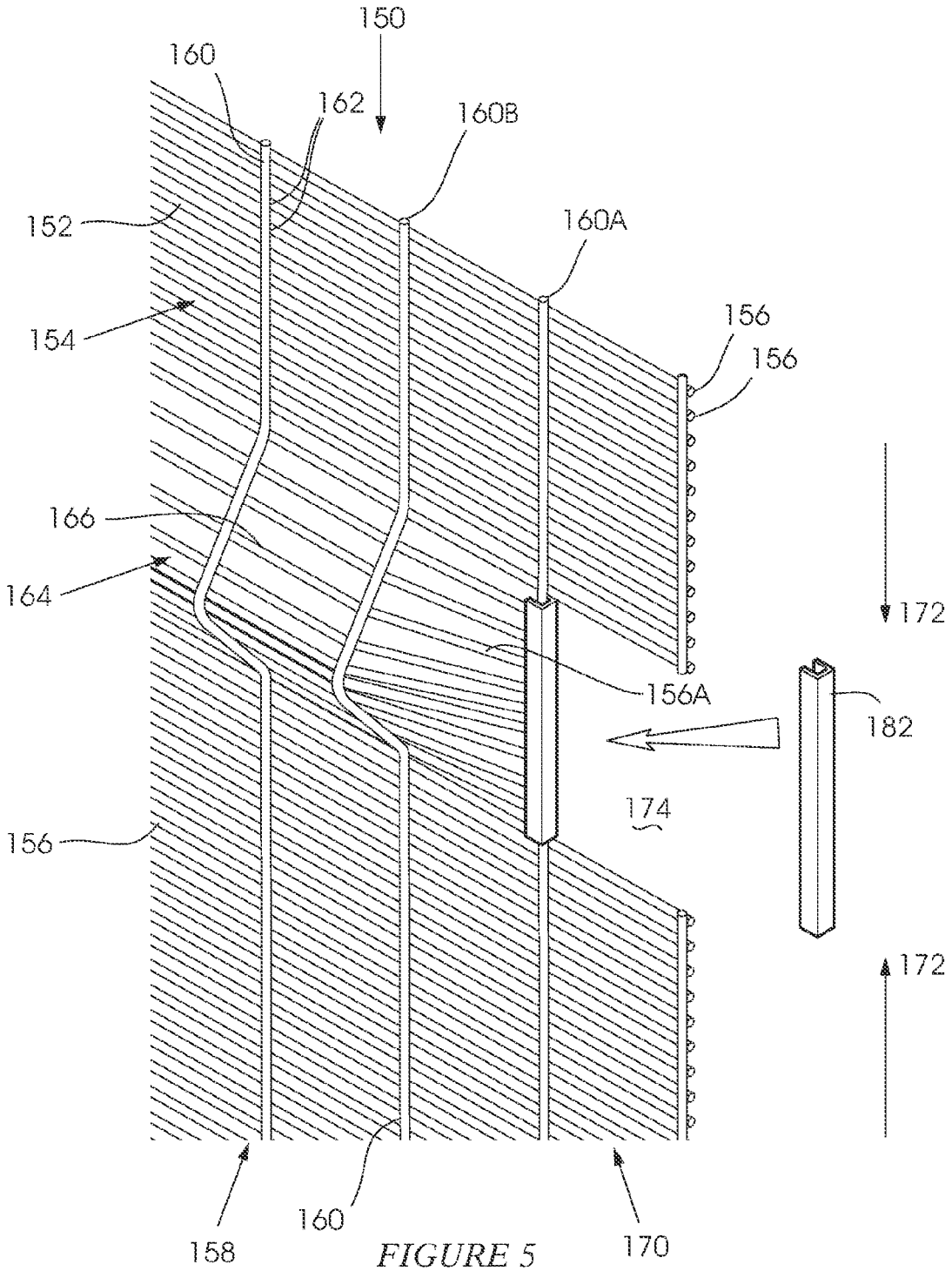
FIG. 5 illustrates in perspective the use of a retention device according to one form of the invention.
Figure 6:
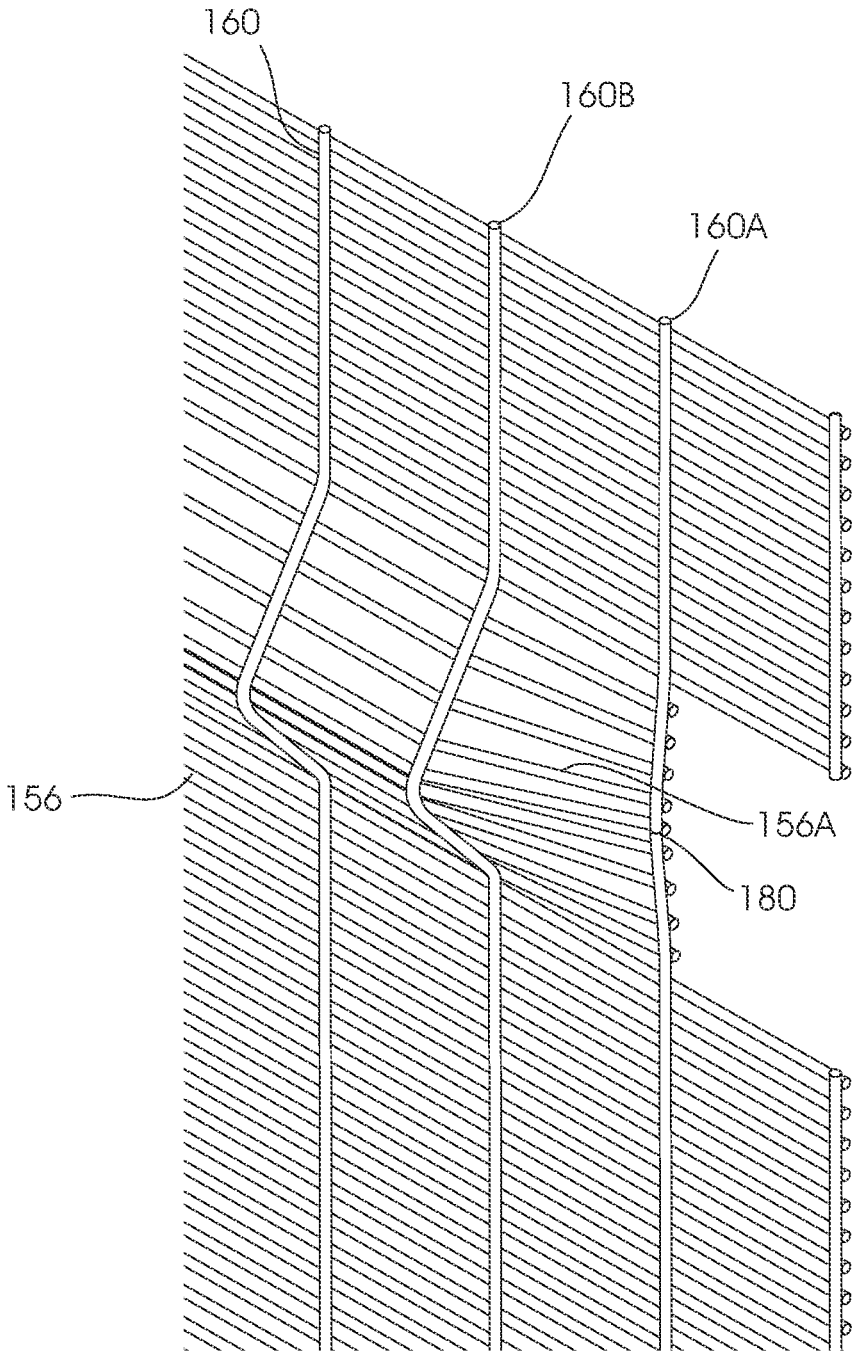
FIG. 6 illustrates a fence panel in accordance with a different form of the invention.
Figure 7:
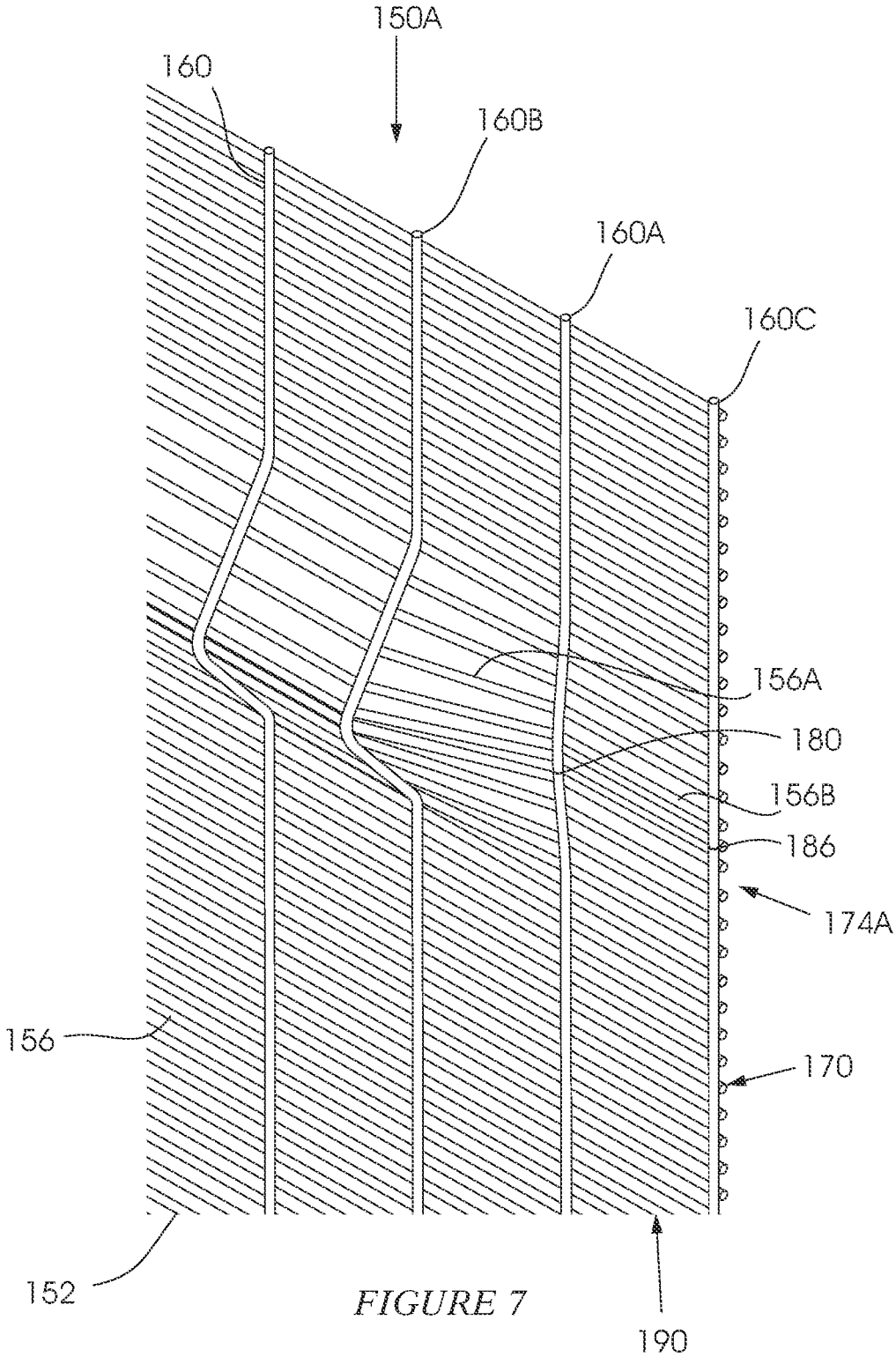
FIG. 7 illustrates a variation of the technique shown in FIG. 6.

FIGS. 5, 6 and 7 show different ways of implementing this alternative approach.

FIG. 5 illustrates a portion of a fence panel 150 made from a sheet 152 of mesh material. The sheet has a first array 154 of closely spaced parallel horizontal rods 156 and a second array 158 of parallel vertical rods 160, which are substantially far apart from each other compared to the rods 156.

The array 154 is transverse to the array 158. The rods in the arrays are welded to one another at overlying points of contact 162 using techniques which are known in the art.

A stiffening formation 164 is defined by a V-shaped channel 166. The channel is formed in a metal working operation, for example in a press.

The sheet 152 has a planar vertical edge section 170 i.e. the edge section does not include a part of the stiffening formation. When the stiffening formation is formed the panel is effectively shortened, in length, in a direction 172. To ensure that the edge 170 remains planar, mesh material is removed to form a gap 174 in peripheral mesh material. A vertical rod 160A adjacent the gap 174 is severed at an intermediate location 180 (see FIG. 6), and sections 156A of the horizontal rods 156, between the vertical rod 160A and an adjacent vertical rod 1608, are deformed so that flying ends of the horizontal rods, adjacent the gap 174, are brought to respective positions which are co-planar with the edge 170. This aspect is also shown in FIG. 6.

Ends of the previously severed vertical rod 160A are cut or trimmed as appropriate and are then butt-welded to each other. Thereafter, a small channel section 182 is placed over the rod 160A adjacent the gap 174 and is welded in position. The channel section helps to strengthen the rod 160A and covers the weld deposit at the abutting ends of the rod 160A.

FIG. 5 shows a form of the invention in which the channel section 182 is used to contain the flying ends of the rods adjacent the gap 174.

In the FIG. 6 embodiment the ends of the severed vertical rod 160A are trimmed and then welded to each other. The channel section 182 is then not necessarily called for.

FIG. 7 shows a fence panel 150A which has a number of similarities to the panel 150. Where applicable like reference numerals are used to designate like components.

In the panel 150A a vertical rod 160C at the edge 170 is severed at a location 186 and the vertical rod 160A is severed at the location 180. Horizontal rod sections 156A are, as before, bent to ensure that the vertical rod 160A is substantially co-planar with the remainder of the mesh sheet 152 and portions of rods 156B (which in the FIG. 6 embodiment are removed to form the gap 174) are left in situ and are shaped to be co-planar with the remainder of the sheet 152. Ends of the severed vertical rod 160C are cut to size, as necessary, and are welded to each other. The stiffening formation is thereby shaped gradually from a maximum depth to what is, effectively, zero depth. A flange 190 at the edge 170 is thus continued even though there may be a slightly irregular spacing of rods over a region in which the gap 174 would otherwise have been formed.

Figure 8:
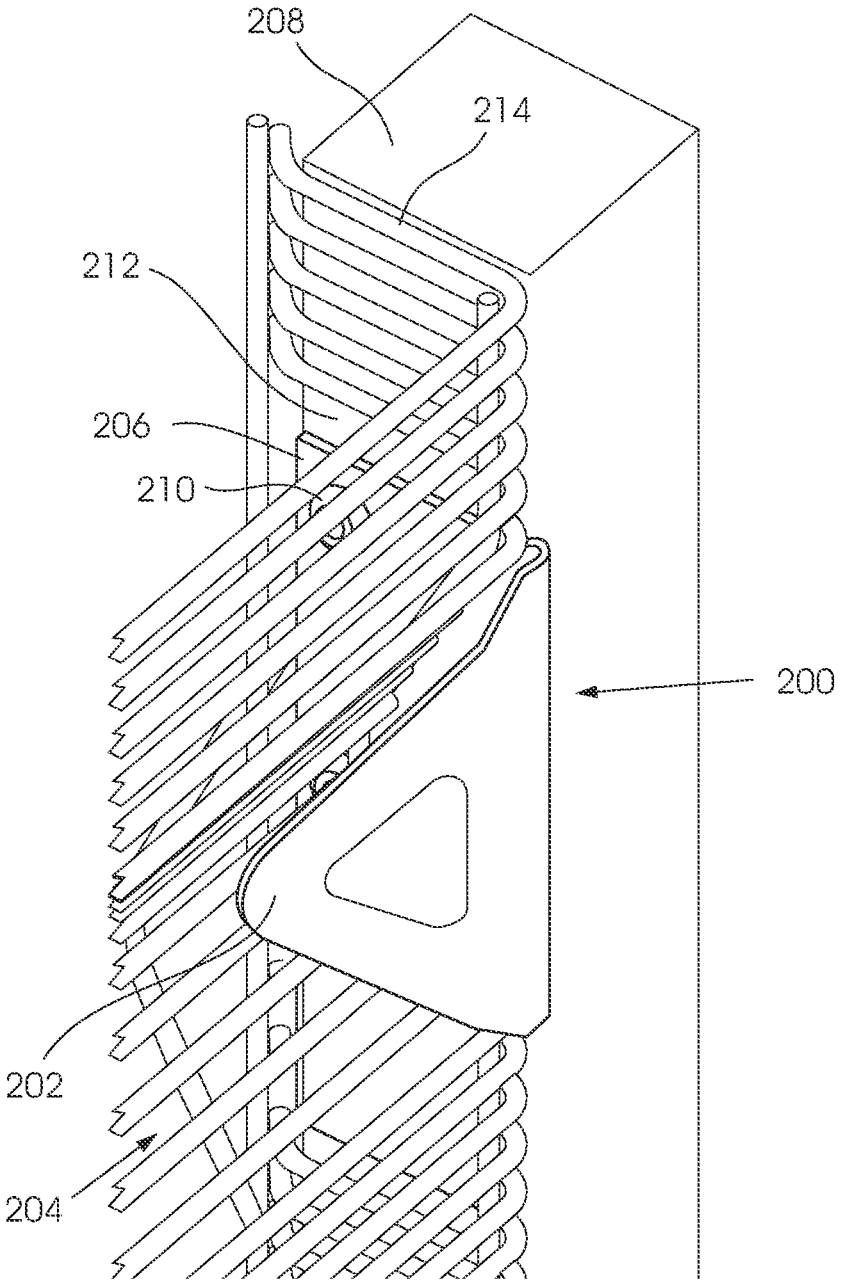
FIGS. 8 and 9 illustrate security devices according to different forms of the invention.

In an alternative approach to the problem the presence of the foothold can be addressed and negated by using a security device 200 of the kind shown, for example, in FIG. 8.

The security device 200 includes a tapered obstructing section 202 which projects into a recess formed by a rigidifying formation 204. An anchor section 206 of the security device is positioned abutting a surface of a fence post 208 and is secured thereto by means of one or more fasteners 210. The anchor section lies in a gap 212 formed in a side of a vertically extending flange 214 of the fence panel. The obstructing section 202 is inclined to a plane occupied by the bulk of the panel and slopes into the rigidifying formation reaching almost to the full depth thereof. An inclined or angled surface which is outwardly presented by the section 202 effectively eliminates a foothold which otherwise would be formed at a junction of the rigidifying formation and the fence post.

Figure 9:
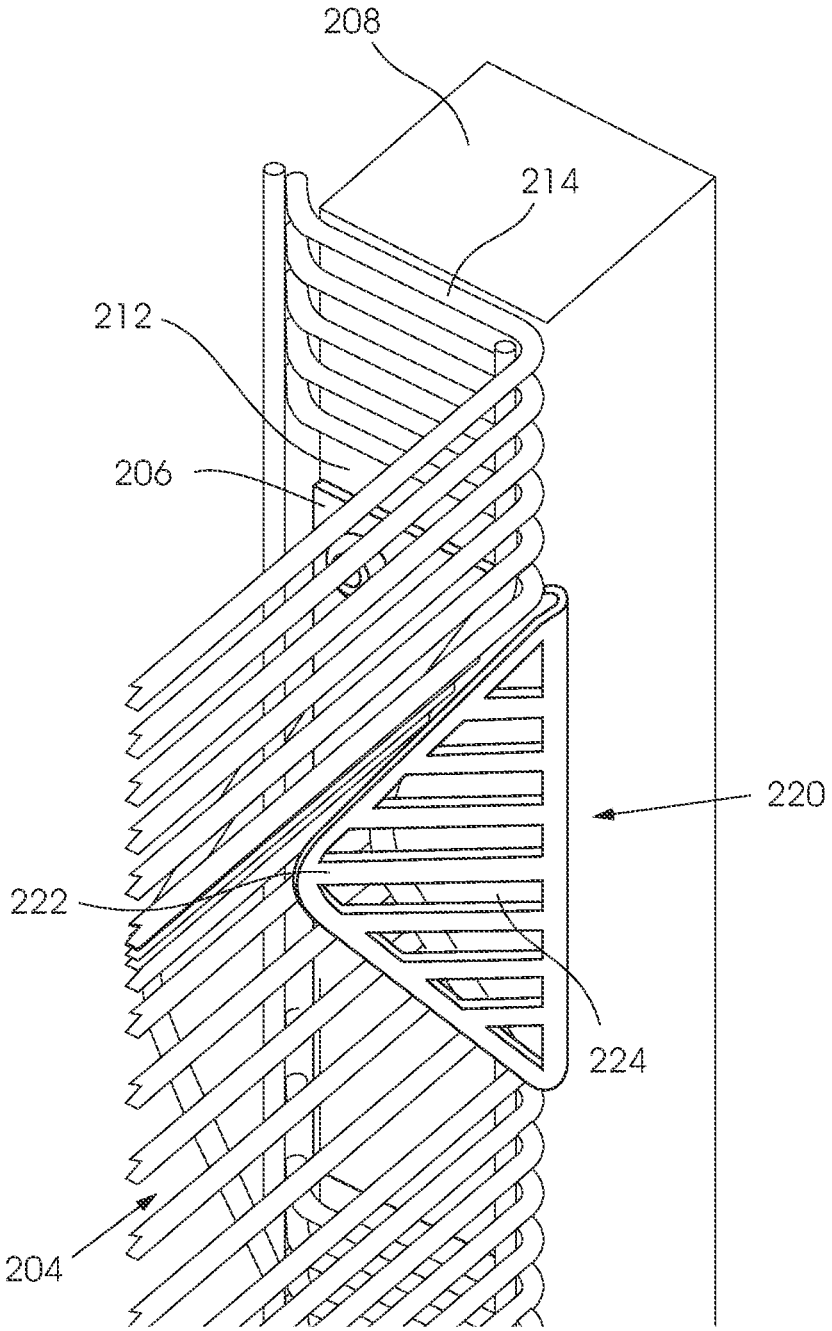

FIG. 9 shows a modified security device 220 which bears a number of similarities to that shown in FIG. 8. Where applicable like reference numerals are used to designate like components. The device 220 has an obstructing section 222 which is formed with a plurality of slots 224 so that the appearance of the obstructing section tends to blend, at least to some extent, with the appearance of the mesh panel. The obstructing section hinders access to an interface between the panel and the post in the region of the recess and it is thus not easily possible for an intruder to gain a foothold at the interface. Another point of importance is that, as is the case with the FIG. 8 embodiment, an intruder cannot easily place a lever between the panel and the post in the region of the gap.

Figure 10:
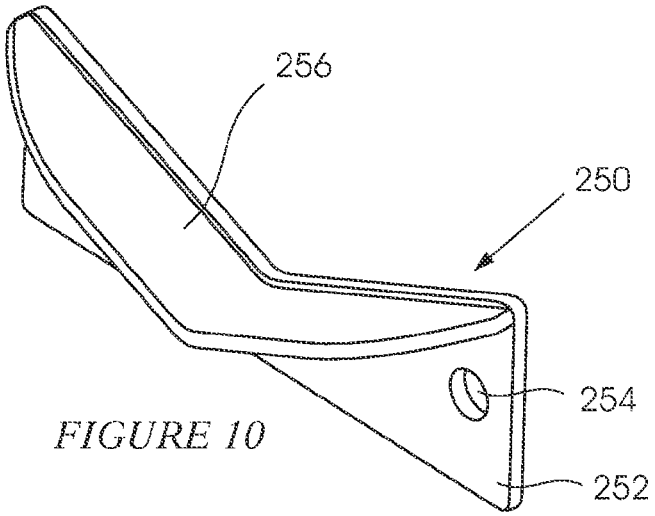
FIGS. 10 to 13 show different types of security devices.

The security devices can have different shapes. FIG. 10 shows a security device 250 which has an anchor section 252 formed with one or more holes 254. The section 252 can thereby be bolted directly to a side of a fence post, not shown. An obstructing section 256 which is welded to the section 252, is generally V-shaped and angled so that, in use, it extends into a reinforcing recess in a mesh panel. The section 256 does not lie flat against a surface of the mesh in the recess, but is spaced therefrom, and so effectively prevents the recess from forming a foothold.

Figure 11:
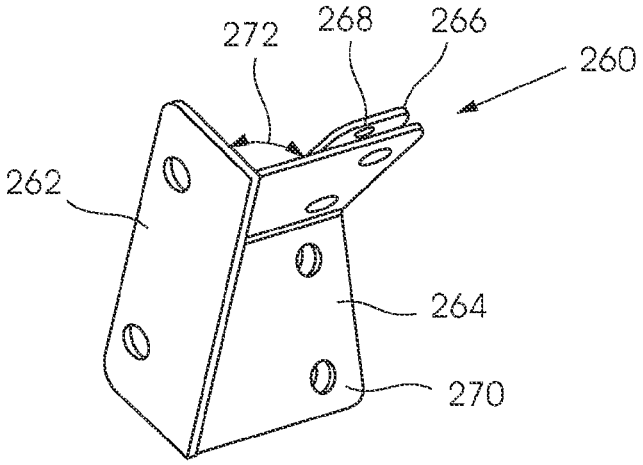

FIG. 11 shows a security device 260 with an anchor section 262 and an obstructing section 264. A clamp 266 with the same cross-sectional shape as the section 264 is formed with holes 268 which can be brought into register with holes 270 in the section 264.

The anchor section 262 is fixed to a side of a post (not shown) with the section 264 partly within a reinforcing recess (stiffening formation) in a panel, not shown. The clamp 260 is positioned on an opposing side of the mesh material which forms the recess, and is fixed to the section 264 by means of fasteners which pass through registering holes 268 and 270. The obstructing section 264 is shaped and positioned to prevent the recess, adjacent the post, from forming a foothold. Usually an angle 272, subtended between the sections 262 and 264, is acute, e.g. from 40° to 60°. Similar considerations apply to the devices in FIGS. 10 and 12.

Figure 12:
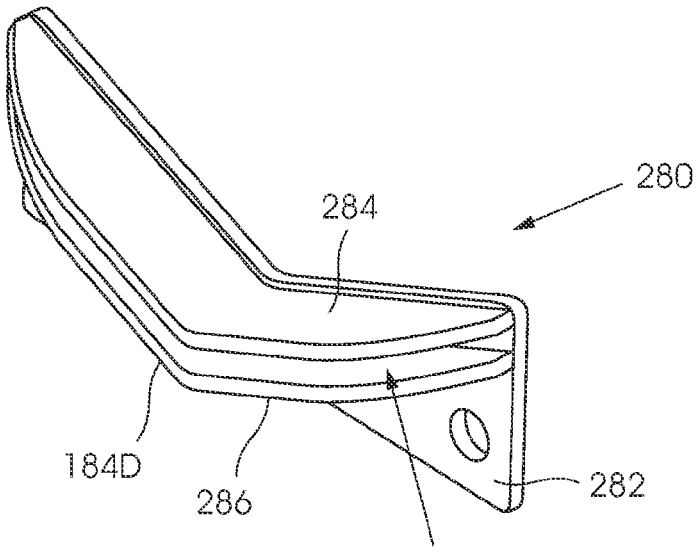

FIG. 12 shows a security device 280 with an anchor section 282 and an obstructing section 284. This is similar to what is shown in FIG. 10. A clamp portion 286 which generally serves the same function as the clamp 266, shown in FIG. 11, is welded to the anchor section 282. A gap 290 is formed between opposing surfaces of the components 284 and 286. The gap receives ends of respective rods (not shown) of the mesh panel with which the device is used. These ends are in a region of the panel at which portions of the corresponding horizontal rods are removed.

The arrangements shown in FIGS. 10, 11, and 12 are not necessarily as effective as the devices shown in FIGS. 8 and 9 in nullifying the foothold effect of a stiffening formation in the mesh panel. However, the devices shown in FIGS. 10, 11 and 12 are highly effective in bracing the panel at a junction between the stiffening formation and a fence post in a manner which helps to prevent a lever being inserted into the junction.

Figure 13:
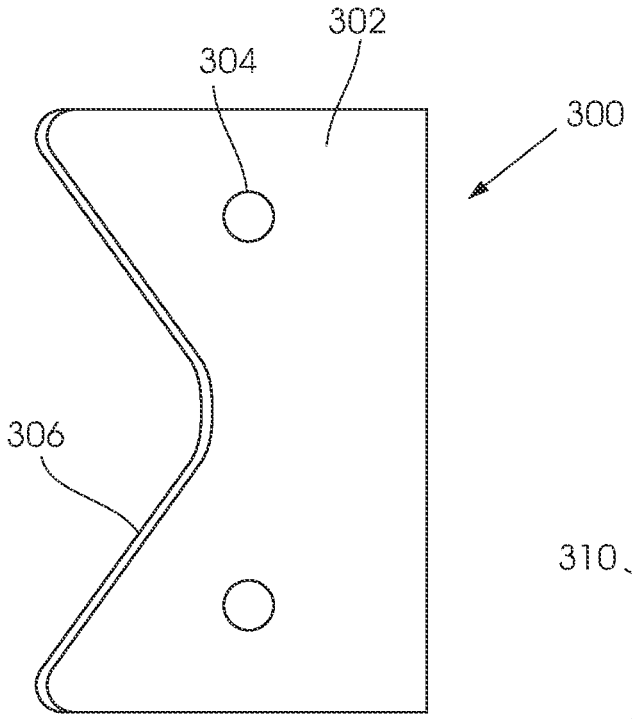
Figure 13A:
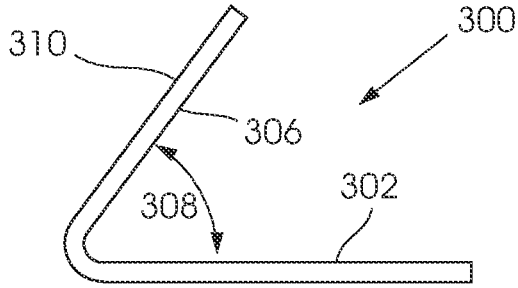
FIG. 13A shows the device of FIG. 13 from one side.

FIG. 13 shows a security device 300 with an anchor section 302 which has holes 304 which are used to bolt the device to a fence post. A V-shaped obstructing section 306 is integrally formed with the section 302. As shown from one side in FIG. 13A the section 306 and the anchor section 302 subtend an included angle 308 which is of the order of 55° (in this example).

The obstructing section 306 will thus extend into a recess of a stiffening formation in such a way that an outer surface 310 of the obstructing section makes it difficult for an intruder to gain a foothold at a junction of the stiffening formation and a support post to which the respective fence panel is attached.

Figure 14:
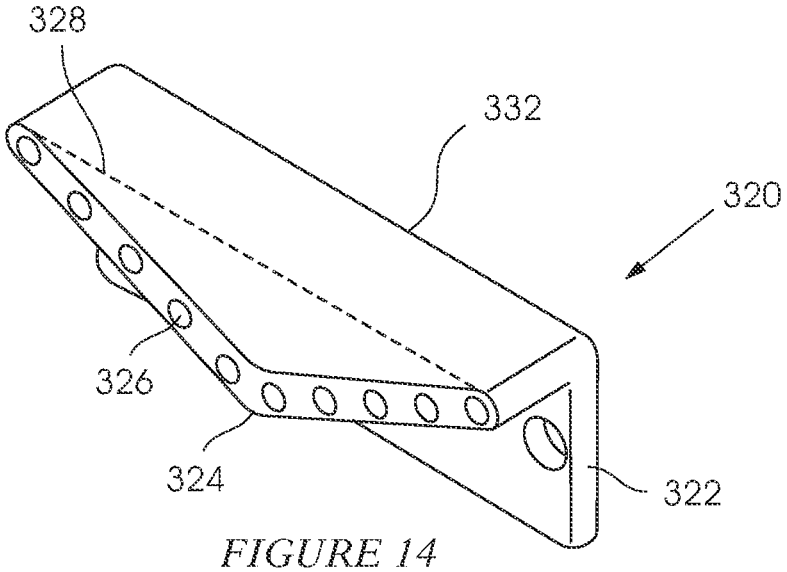
FIG. 14 shows a security device which is cast or moulded.

FIG. 14 shows a security device 320 which is made from a moulded or cast plastics or other material. The device has a body with an integrally formed anchor section 322 and an obstructing section 324 which is formed with a plurality of spaced holes 326 into which flying ends of rods of the fence panel, adjacent the recessed region, are inserted. The device 320 can thus function to prevent a lever from being inserted into a gap between a fence post and an adjacent mesh fence panel which has a stiffening channel. The body can also be formed in a bulkier manner in that the dimensions of the obstructing section 324 are increased (as shown in dotted outline 328) so that an outwardly facing surface 330 is formed which, in use, extends at an angle into a stiffening channel, in a mesh panel, of the kind referred to hereinbefore.

Figure 15:
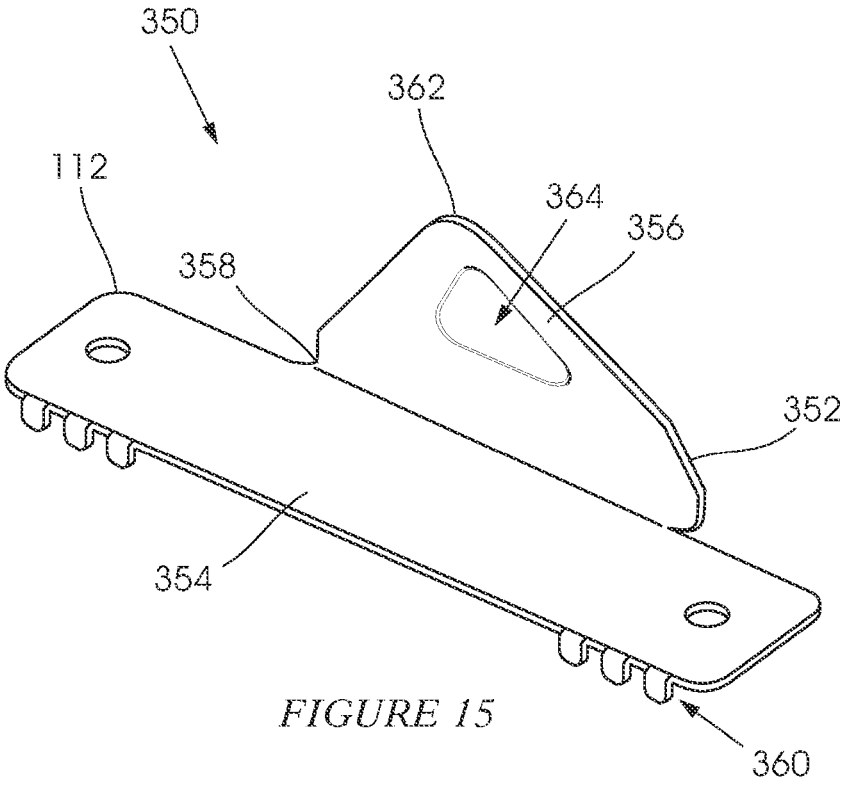
FIG. 15 shows a security device according to another form of the invention.

FIG. 15 is a view in perspective of a security device 350 which has a body 352 made from sheet metal. The sheet metal is formed to have an anchor section 354 and an obstructing section 356. A small bridging section 358 interconnects the obstructing section to the anchor section.

The anchor section has a generally elongate rectangular shape and has sets of formations 360 at four locations. The formations are roughly hook-shaped.

The obstructing section 356 has a general V-shape with a rounded apex 362. The obstructing section is stiffened by means of a stamped indent or recess 364.

Figure 16:
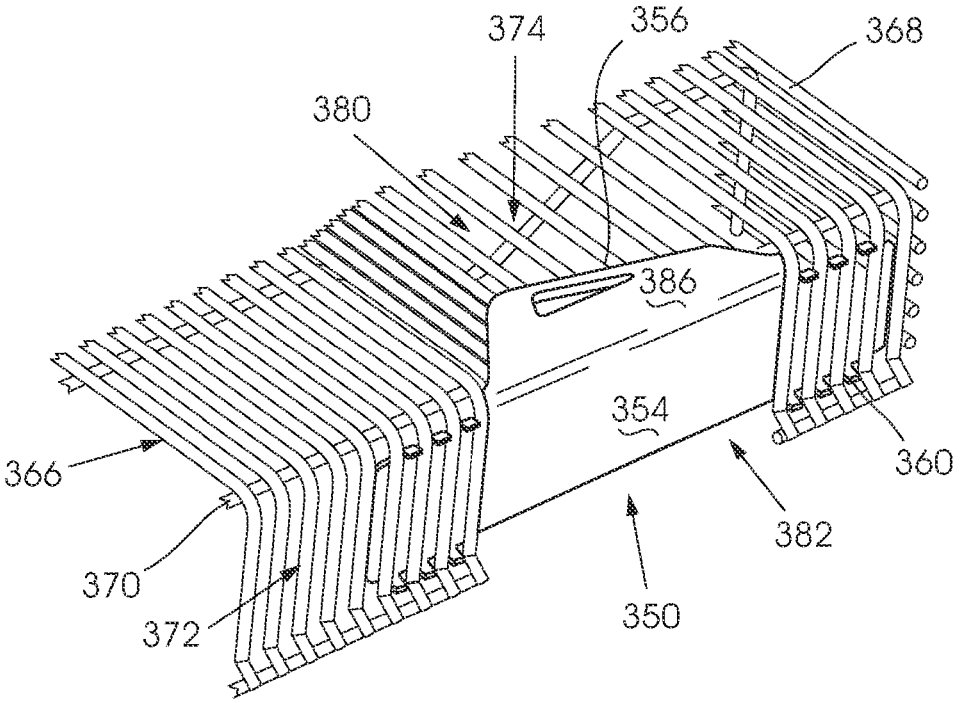
FIG. 16 shows the device of FIG. 15 engaged with a shaped portion of a mesh panel.

FIG. 16 illustrates the security device 350 and a portion of a mesh panel 366.

The panel 366 has a plurality of rods 368 which, in use, extend horizontally and a plurality of rods 370 which are welded to the rods 368 and which thereby make up the mesh configuration of the panel. The panel has a flange 372 which is formed by bending a vertical edge portion of the panel through approximately 80° to 90°. A transversely extending stiffening formation 374, formed in the panel, has opposed walls, each of which has several horizontal rods, which define a shallow V-shaped recess 380 between them. At a junction of the formation 374 and the flange 372 material is removed thereby to form a region 382 which is free of the rods.

The device 350 is shaped so that it can be engaged with the flange 372 and so that the obstructing section 356 projects, at least partly, into the recess 380. The rectangular anchor section 354 is then positioned on one side of the mesh material with the formations 360 extending through respective mesh apertures. The obstructing section 356 is on an opposing side of the mesh panel and tapers into the recess 380. The section 356 thus presents a surface 386 which is at an angle to a plane occupied by the bulk of the panel i.e. the plane in which the greater portions of the rods 368 lie.

Figure 17:
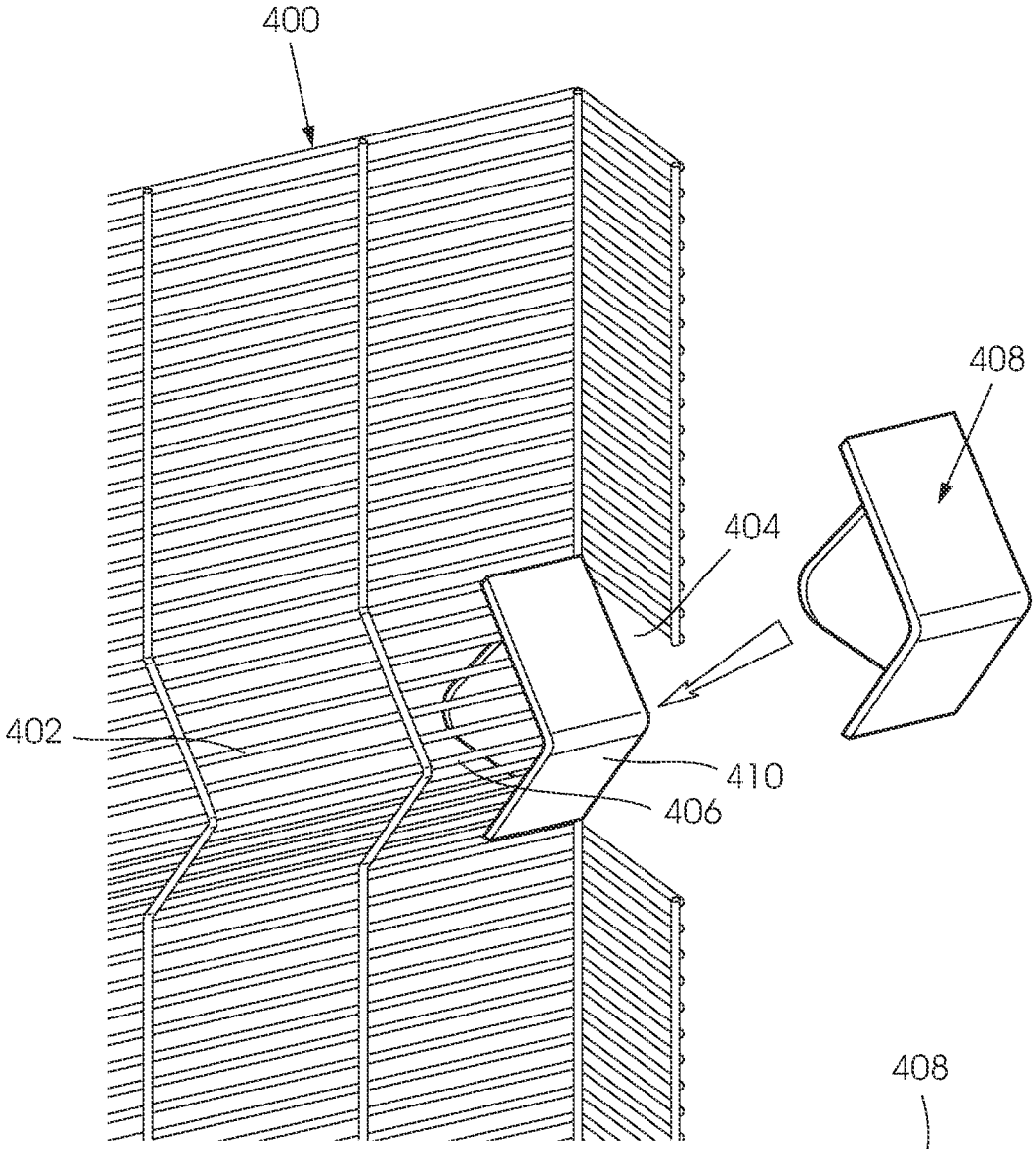
FIGS. 17 and 17A show another technique provided by the invention.
Figure 17A:
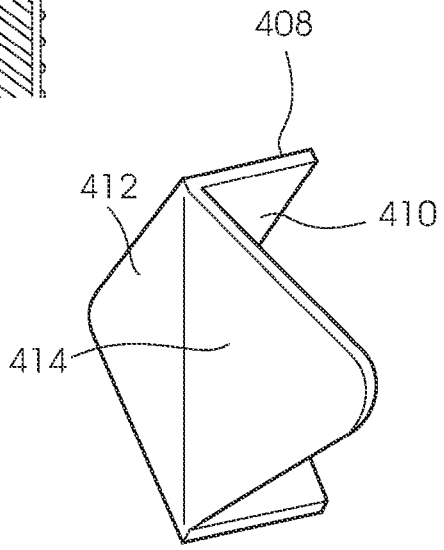

FIG. 17 shows part of a fence panel 400 with a stiffening formation 402. A gap 404 is formed adjacent an end of the stiffening formation. Rods 406 are left to follow the shape of the stiffening formation. A reinforcing component 408 is welded to ends of the rods. The reinforcing component, shown from one side in FIG. 17A, has a flat bar section 410 with overlies an outer side of the stiffening formation, a plate 412 which abuts a side of a post (not shown) to which the plate is fixed and an inclined plate 414 which extends into the recess of the stiffening formation.

The invention claimed is:

1. A fence panel which is made from mesh material, the panel being rectangular in outline, the panel defining a planar body lying within a plane, the panel having a first edge being secured to a first fence post, a second edge, opposing the first edge, the second edge being secured to a second fence post which is spaced from the first fence post, a third edge at a right angle to the first edge and a fourth edge opposing the third edge, the panel comprising at least one elongate rigidifying channel formed by deforming the mesh out of the plane of the planar body of the fence panel, which is substantially parallel to and located between the third edge and the fourth edge, the channel including a longitudinal axis parallel to the third edge and the fourth edge and lying on the plane of the fence panel, the channel defining a channel bottom lying on a plane offset to the planar body and having a first end adjacent the first edge, a second end, opposing the first end and adjacent the second edge, the channel over a substantial portion of its length between the first end and the second end having a uniform cross section and having a substantially uniform width and a depth, wherein the channel, in a region adjacent each of the first end and the second end, is of decreasing depth along the longitudinal axis and tapering in width toward a point lying in the plane of the planar body of the fence panel on the longitudinal axis, thereby to inhibit the formation of a foothold at a junction of the panel and the first post.

2. A fence panel according to claim 1 wherein the panel is square in outline.

3. The fence panel of claim 1, wherein at least a portion of the channel bottom extends substantially parallel to the plane of the planar body.

4. A fence for security applications, the fence comprising:

a first fence post;

a second fence post spaced from the first fence post;

a fence panel made from mesh material, the fence panel being rectangular in outline and defining a planar body lying within a plane, the fence panel including:

a first edge secured to the first fence post, a second edge secured to the second fence post, a third edge at a right angle to the first edge, a fourth edge opposing the third edge, and at least one rigidifying channel formed by deforming the mesh out of the plane of the planar body of the fence panel and defining a longitudinal axis at a channel bottom, the axis being substantially parallel to and located between the third edge and the fourth edge and lying offset to the plane of the fence panel, the channel having a first end adjacent the first edge, a second end adjacent the second edge, the channel having a uniform cross section over a substantial portion of its length between the first end and the second end; and a security device including:

an anchor section having at least one fixing formation for fixing the security device to one of the first and the second fence posts, and an obstructing section having a length and a width, the obstructing section being inclined relative to the anchor section and projecting from the anchor section at a location adjacent the plane of the planar body of the fence panel to a location offset from the plane at least partially into the at least one rigidifying channel and at least partially along an axis parallel to the longitudinal axis at the channel bottom, the obstructing section tapering in width along its length to the location offset from the plane.

5. The fence of claim 4, wherein the at least one rigidifying channel includes first and second rigidifying channels, the first and second rigidifying channels being substantially parallel to each other and extending substantially perpendicular to the first fence post and the second fence post.

6. The fence of claim 4, wherein the first and second edges extend substantially vertically and wherein the anchor section abuts one of the first and second vertical edge portions of the mesh material.

7. The fence of claim 4, wherein the obstructing section is shaped substantially identical to the channel.

8. The fence of claim 4, wherein the obstructing section projects at an acute angle with respect to the anchor section.

9. The fence of claim 4, wherein the anchor section further includes a plurality of spaced-apart formations which are positioned so that the spaced apart formations are insertable into respective apertures in the mesh material.

10. The fence of claim 4, wherein at least a portion of the channel bottom extends substantially parallel to the plane of the planar body.

* * * * *